US007837174B2

(12) United States Patent
McNamara

(10) Patent No.: US 7,837,174 B2
(45) Date of Patent: Nov. 23, 2010

(54) MODULAR FORMWORK WALL WITH DOVETAIL JOINT CONNECTORS

(76) Inventor: Bernard McNamara, 660, Pine, St-Lambert, QC (CA) J3V 6B9

( * ) Notice: Subject to any disclaimer, the term of this patent is extended or adjusted under 35 U.S.C. 154(b) by 822 days.

(21) Appl. No.: 11/721,919

(22) PCT Filed: Dec. 23, 2004

(86) PCT No.: PCT/CA2004/002195

§ 371 (c)(1),
(2), (4) Date: Jun. 15, 2007

(87) PCT Pub. No.: WO2006/066379

PCT Pub. Date: Jun. 29, 2006

(65) Prior Publication Data

US 2009/0272876 A1 Nov. 5, 2009

Related U.S. Application Data

(60) Provisional application No. 60/546,988, filed on Feb. 24, 2004.

(51) Int. Cl.
*E04G 11/08* (2006.01)

(52) U.S. Cl. ..... 249/45; 249/43; 249/219.2

(58) Field of Classification Search ..... 249/190–192, 249/44, 45, 47, 40, 193, 216, 217, 213, 43, 249/219.2, 48; 52/509, 508; 403/381
See application file for complete search history.

(56) References Cited

U.S. PATENT DOCUMENTS

| | | | | | |
|---|---|---|---|---|---|
| 518,464 | A | * | 4/1894 | Moore | 52/509 |
| 1,014,630 | A | * | 1/1912 | Morrill | 249/20 |
| 1,250,032 | A | * | 12/1917 | Schub | 249/43 |
| 2,725,127 | A | * | 11/1955 | Barrett et al. | 52/507 |
| 2,735,523 | A | * | 2/1956 | Leyerle et al. | 52/509 |
| 2,921,462 | A | | 1/1960 | Wilson | |
| 3,168,772 | A | * | 2/1965 | Williams | 249/42 |
| 3,357,672 | A | * | 12/1967 | Capek | 249/45 |
| 3,647,173 | A | * | 3/1972 | Pipala | 249/31 |
| 3,750,997 | A | * | 8/1973 | Andersen et al. | 249/47 |
| 3,888,456 | A | | 6/1975 | Umstead | |
| 4,033,548 | A | | 7/1977 | Shahar | |
| 4,044,986 | A | | 8/1977 | Strickland et al. | |
| 4,085,495 | A | * | 4/1978 | Hebert | 29/469 |
| 4,234,156 | A | | 11/1980 | Wepf | |

(Continued)

*Primary Examiner*—Janet M Wilkens
(74) *Attorney, Agent, or Firm*—Fraser Clemens Martin & Miller LLC; J. Douglas Miller

(57) ABSTRACT

A formwork assembly for casting a concrete structure includes a support member for supporting a conventional armature grid if any, further including at least one liquid-tight and load-bearing formwork wall connected to the support member. The formwork wall includes at least two panels, each defining a peripheral edging having at least one first dovetail joint element about its peripheral edging. Each formwork wall also has a panel connector having at least two second dovetail joint elements, each second dovetail joint element being complementary to the first dovetail joint element of a corresponding panel and is interlocked with the first dovetail joint element of a corresponding panel to form a dovetail joint, the connector holding the panels in an edgewisely juxtaposed fashion to form a continuous formwork wall. The formwork assembly includes a securing member for securing the connector and panels together, and a supporting structure for supporting the formwork wall.

11 Claims, 13 Drawing Sheets

U.S. PATENT DOCUMENTS

| | | | | | |
|---|---|---|---|---|---|
| 4,280,677 | A | | 7/1981 | Shahar | |
| 4,430,837 | A | * | 2/1984 | Kirschenbaum | 52/506.05 |
| 4,519,173 | A | * | 5/1985 | Roberts | 52/235 |
| 4,578,910 | A | * | 4/1986 | Germeroth et al. | 52/105 |
| 4,922,670 | A | * | 5/1990 | Naka et al. | 52/126.6 |
| 5,280,690 | A | * | 1/1994 | Hu | 52/513 |
| 5,333,423 | A | * | 8/1994 | Propst | 52/126.6 |
| 5,687,522 | A | | 11/1997 | Durande et al. | |
| 5,704,180 | A | | 1/1998 | Boeck | |
| 5,809,725 | A | | 9/1998 | Cretti | |
| 5,852,907 | A | * | 12/1998 | Tobin et al. | 52/714 |
| 6,308,484 | B1 | | 10/2001 | Severino | |
| 6,718,709 | B2 | * | 4/2004 | Koutras et al. | 52/285.1 |
| 2009/0166356 | A1 | * | 7/2009 | Tsai | 220/4.01 |

* cited by examiner

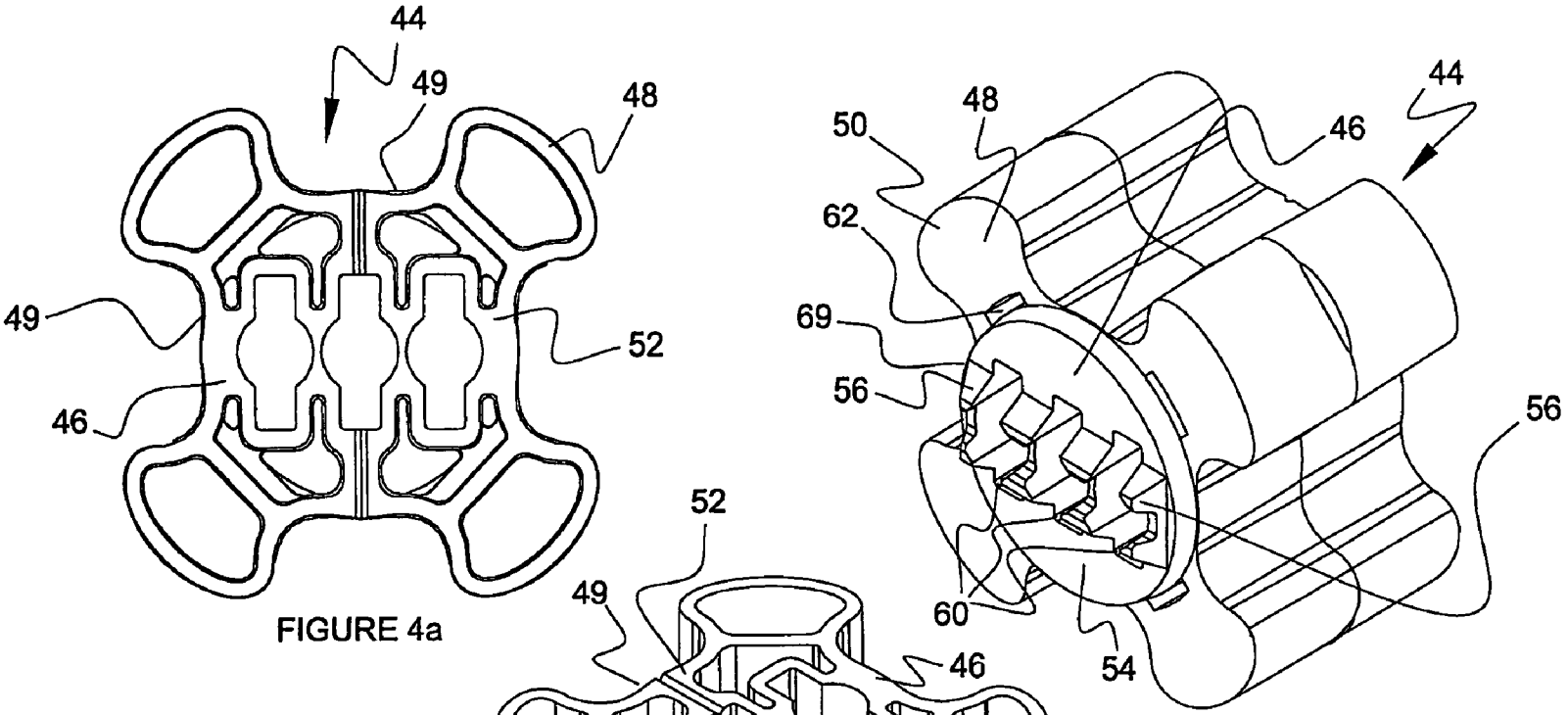
FIGURE 4b
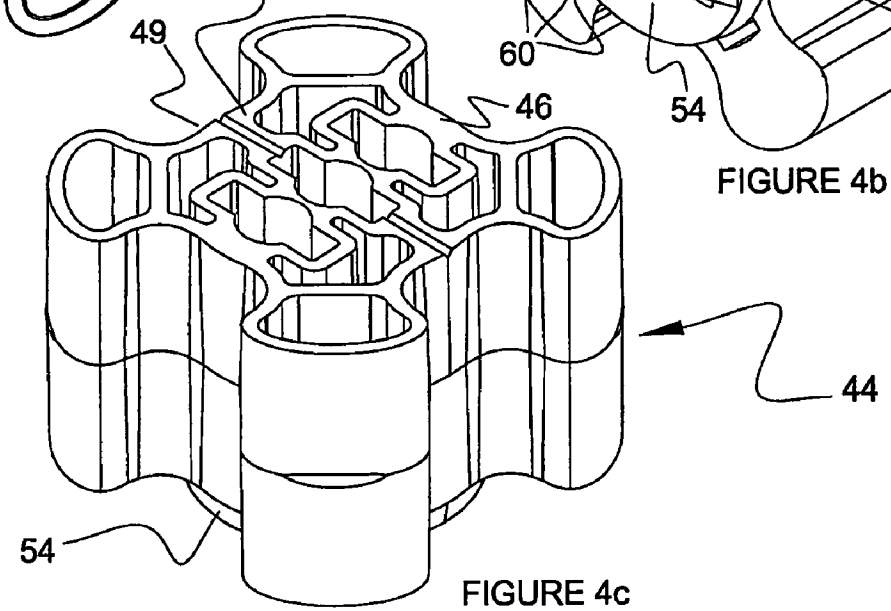
FIGURE 4c
FIGURE 4a

MODULAR FORMWORK WALL WITH DOVETAIL JOINT CONNECTORS

CROSS-REFERENCE DATA

This application claims convention priority based upon co-pending U.S. provisional patent application No. 60/546,988 filed Feb. 24, 2004.

FIELD OF THE INVENTION

The present invention relates to formworks for containing liquid concrete, and more particularly to a modular formwork assembly comprising a number of modular panels and dovetail joint panel connectors for use in building construction. The modular panels are reusable.

BACKGROUND OF THE INVENTION

All liquid concrete that is still uncured needs to be contained by load bearing means, to hold the concrete in place until it hardens sufficiently to hold its own shape. With concrete slabs, the freshly-poured concrete may be retained by existing features such as upright walls, curbs, edgings, etc., or by some form of temporary shuttering also known as a "formwork". Formworks can be quite expensive; indeed, the cost of formworks generally represents a significant proportion of the total cost of the completed concrete structure.

Inexpensive formworks can be made of an assembly of wooden boards and stakes. However, the wooden boards and stakes of the formworks are known to adhere to the concrete once dried and hardened in the formwork, unless they are lubricated prior to use. Therefore, workmen therefore generally have to oil up the wooden boards and stakes, which is a time-consuming, messy and generally inconvenient task, in order to afterwards be able to remove the formwork from the cured concrete.

A relatively new alternative to wooden formworks are formworks made of thermoplastic panels. However, existing thermoplastic formworks are generally inconvenient to set up.

SUMMARY OF THE INVENTION

The present invention relates to a liquid-tight formwork wall for use in a formwork assembly for forming a concrete structure, said formwork wall comprising:

- at least two panels each defining a peripheral edging, each one of said panels having at least one first dovetail joint means about its said peripheral edging;
- a panel connector having at least two second dovetail joint means, each said second dovetail joint means being complementary to said first dovetail joint means of a corresponding one of said panels; wherein each said second dovetail joint means is interlocked with said first dovetail joint means of a corresponding one of said panels to form a dovetail joint therewith, in order for said connector to hold said panels in an edgewisely juxtaposed fashion to form said formwork wall; and
- a securing member for securing said connector and said panels with one another.

In one embodiment, said first dovetail joint means are female dovetail joint means, and said second dovetail joint means are male dovetail joint means.

In one embodiment, each said male dovetail joint means of said connector is lobe-shaped.

In one embodiment, said peripheral edging of each of said panels has a generally quadrangular shape, and each panel thus defines four corners.

In one embodiment, each one of said panel comprises a first dovetail joint means at each one of said corners thereof.

In one embodiment, the formwork wall further comprises at least one fastening means for fastening together juxtaposed sections of said peripheral edging of said at least two panels of said formwork walls.

In one embodiment, the formwork wall further comprises at least one support member attached to said formwork wall, for supporting an armature grid adjacently to said formwork wall.

In one embodiment, the formwork wall further comprises an elongated threaded rod having at least one end portion extending outwardly of said support member, said threaded rod penetrating across a through channel made in said panel connector, said securing member including a nut screwed onto said threaded rod and pressing said connector and said panels against said support member.

In one embodiment, said at least one support member defines opposite first and second ends, and is attached at said first end to a first one of said at least one formwork wall, and is further attached at said second end to a second one of said at least one formwork wall, said support member maintaining said first and second formwork walls spaced apart from each other.

The present invention also relates to a formwork assembly for casting a concrete structure, said formwork assembly comprising:

- at least one liquid-tight and load-bearing continuous formwork wall, said formwork wall comprising:
  - at least two panels each defining a peripheral edging, each one of said panels having at least one first dovetail joint means about its said peripheral edging; and
  - a panel connector having at least two second dovetail joint means, each said second dovetail joint means being complementary to said first dovetail joint means of a corresponding one of said panels; wherein each said second dovetail joint means is interlocked with said first dovetail joint means of a corresponding one of said panels to form a dovetail joint therewith, in order for said connector to hold said panels in an edgewisely juxtaposed fashion to form said continuous formwork wall;
- a supporting structure supporting said formwork wall in a desired position;
- a securing member for securing said connector, said panels and said supporting structure together.

The present invention relates to said first dovetail joint means are female dovetail joint means, and said second dovetail joint means are male dovetail joint means.

The present invention relates to each said male dovetail joint means of said connector is lobe-shaped.

The present invention relates to said peripheral edging of each of said panels has a generally quadrangular shape, and each panel thus defines four corners.

The present invention relates to each one of said panel comprises a first dovetail joint means at each one of said corners thereof.

In one embodiment, the formwork assembly further comprises at least one fastening means for fastening together juxtaposed sections of said peripheral edging of said at least two panels of said formwork walls.

In one embodiment, the formwork assembly further comprises at least one support member attached to said formwork wall, for supporting an armature grid adjacently to said formwork wall.

In one embodiment, said supporting structure holds said formwork wall in a horizontal position.

In one embodiment, said supporting structure comprises a number of horizontally arranged floor joists.

In one embodiment, said panel connector registers with said support member and with one of said floor joists, said formwork assembly further comprising an elongated threaded rod having at least one end portion extending outwardly of said support member, said threaded rod penetrating across a through channel made in said panel connector and through said floor joist, said securing member including a nut screwed onto said threaded rod securing said panel connector, said panels, said support member and said floor joists together.

DESCRIPTION OF THE DRAWINGS

In the annexed drawings:

FIGS. 4*a*-4*c* show a rear plan view, and front and rear perspective views respectively of a dovetail panels connector;

DETAILED DESCRIPTION OF THE EMBODIMENTS

Figure 1:
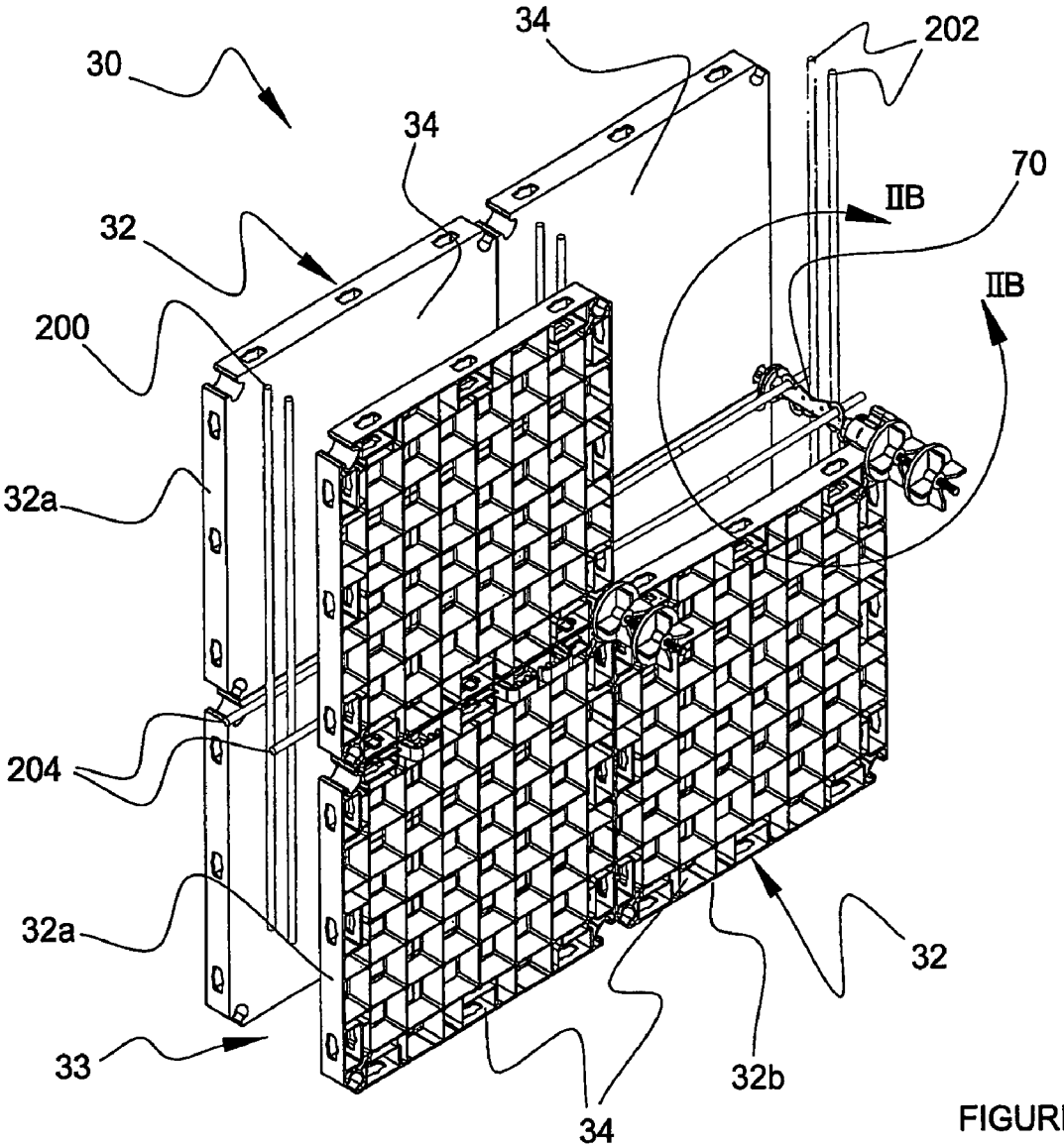
FIG. 1 shows a front perspective view of a modular formwork assembly according to the present invention.

FIG. 1 shows a modular formwork assembly 30 according to one embodiment of the present invention. Although it could be used with other construction materials which can be cast in a formwork, the present invention will be described as being used for casting concrete structures.

Formwork assembly 30, shown in an upright disposition in FIG. 1 to cast vertical walls for example, comprises two liquid-tight formwork walls 32, 32 facing each other and separated by a vertical gap 33. Formwork walls 32, 32 can optionally support a conventional armature grid 200 extending vertically through gap 33, and located intermediate walls 32, 32, if structurally required.

Armature grid 200 comprises of a number of pairs of horizontal and parallel armature rods 204 supported by a number of support members 70 connected to the formwork walls, and a number of pairs of vertical and parallel armature rods 202 orthogonally affixed to horizontal armature rods 204 also in a known fashion, for example using iron wire to tie them together.

Figure 2A:
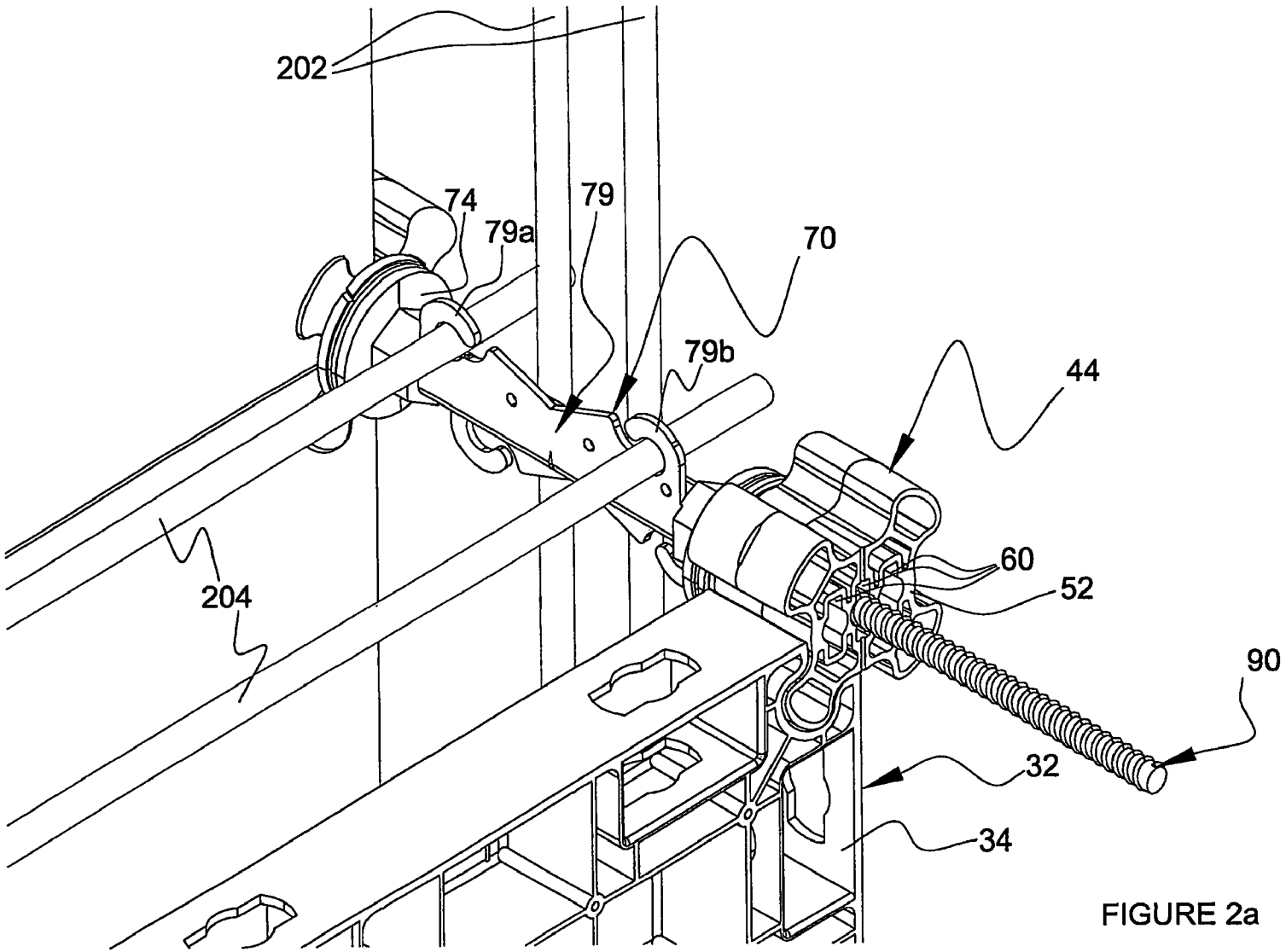
FIG. 2*a* substantially shows an enlarged view of the area circumscribed within ellipse IIB-IIB of FIG. 1, but with the two wing nuts mounted on the threaded rod being removed.
Figure 2B:
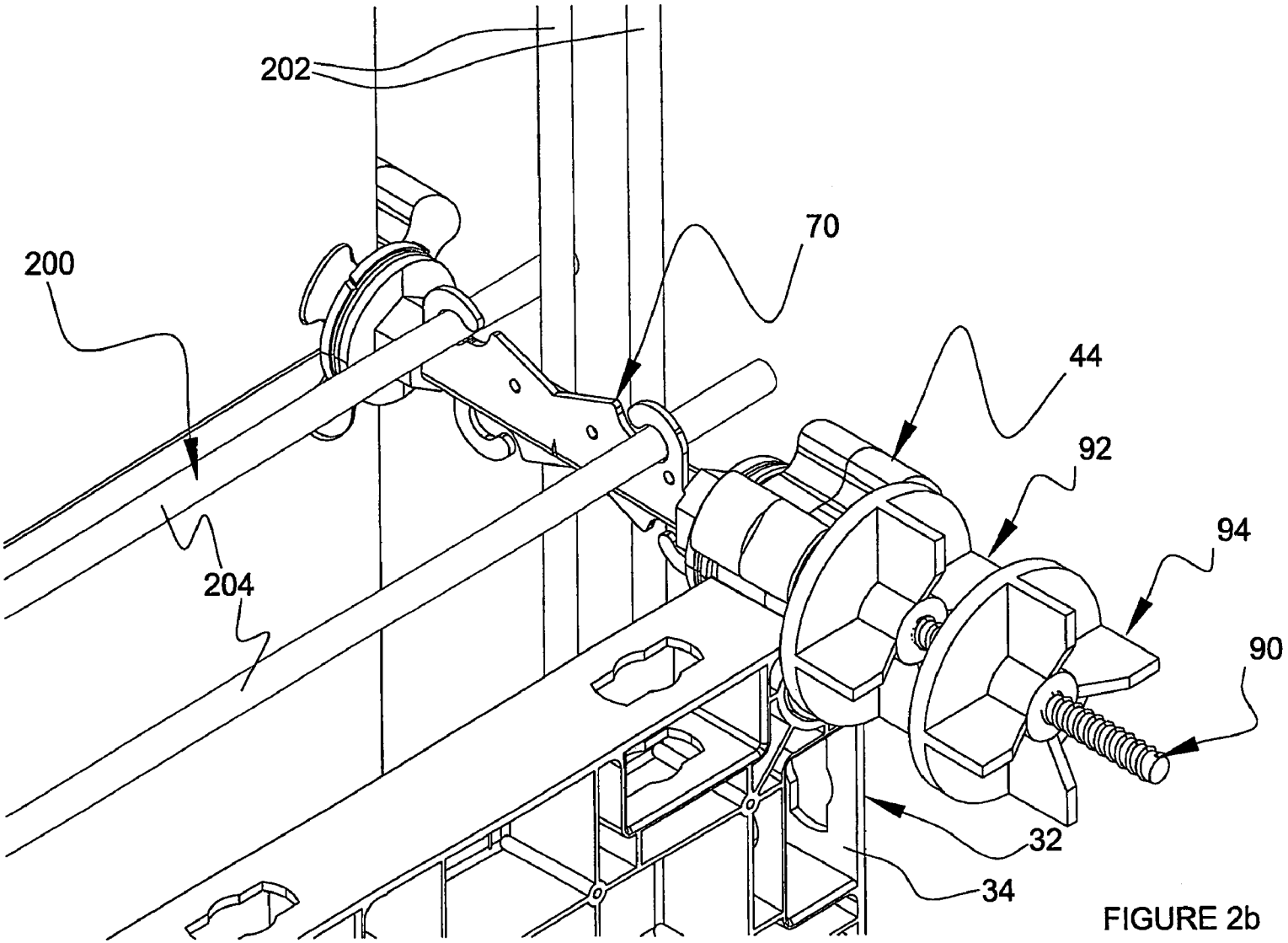
FIG. 2*b* is a view similar to FIG. 2*a* but with the two wing nuts in place.
Figure 3:
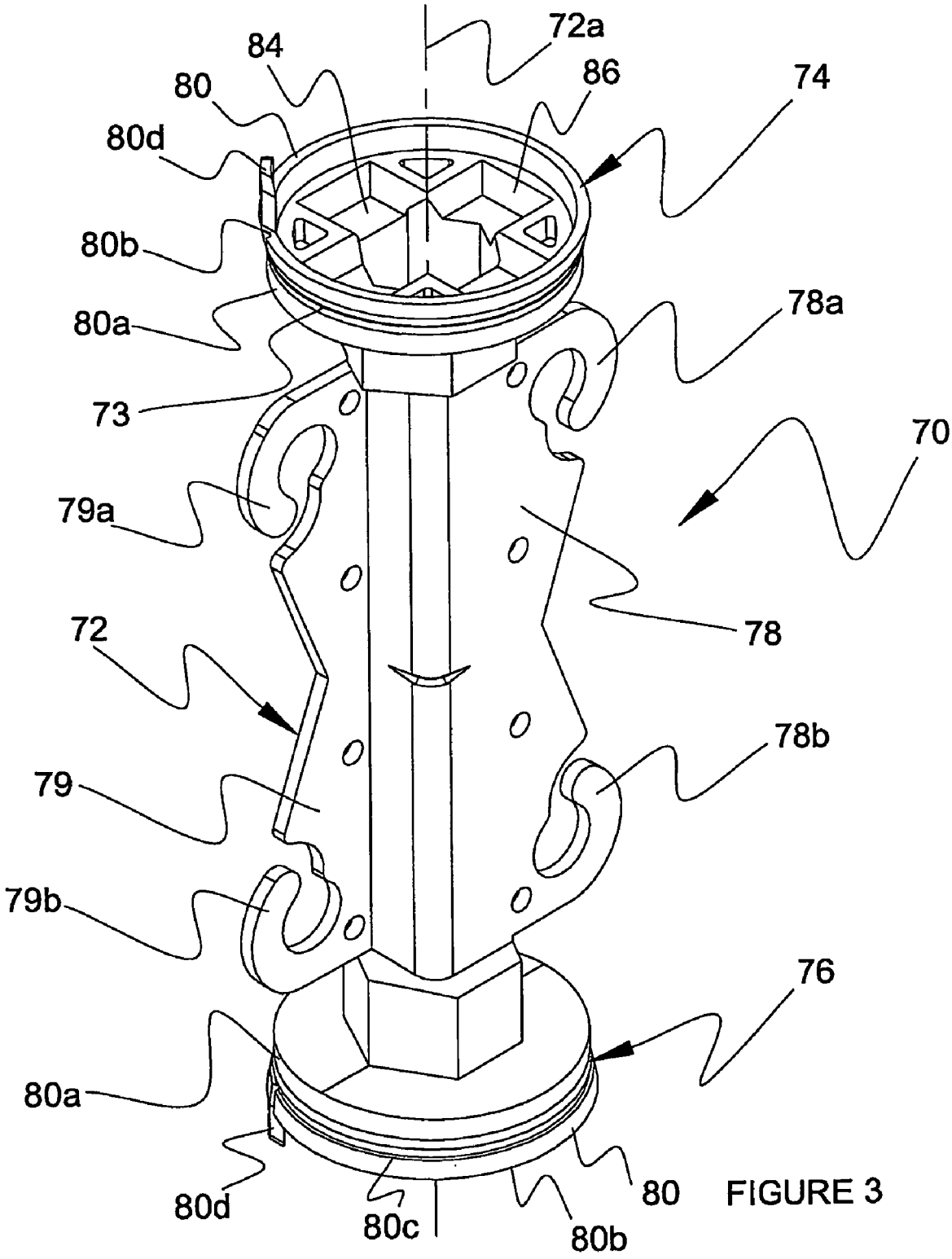
FIG. 3 shows an enlarged perspective view of one of the support members of FIGS. 2*a* and 2*b;*

Formwork walls 32, 32 are kept parallel and spaced apart from each other by a number of support members 70, which, as mentioned previously, also serve to support the optional armature grid 200 between formwork 32, 32. Each support member 70, as shown in FIGS. 2*a*-2*b* and 3, comprises an elongated central section 72 defining a longitudinal axis 72*a*, and two discoid alignment knobs 74, 76 integrally and radially attached at each of the opposite ends of central section 72.

Central section 72 is hollow and defines a longitudinal inner cavity (concealed in the drawings) extending along longitudinal axis 72*a*, and opening to the outside at the center of each of end knobs 74, 76 coaxially to axis 72*a*, for example at the center 73 of end knob 74. Moreover, radially on the outer surface of central section 72 are integrally affixed two radially extending bracket members 78 and 79, which are axially symmetrically spaced apart relative to longitudinal axis 72*a*. Each one of bracket members 78, 79 defines two curved fingers 78*a*, 78*b* and 79*a*, 79*b*. One of these pairs of fingers 78*a*, 78*b* or 79*a*, 79*b* is destined to wrap around and hook onto a pair of parallel armature rods—either vertical of horizontal—from armature grid 200. In the embodiment of the figures, curved fingers 79*a*, 79*b* of support members 70 are wrapped around pairs of horizontal armature rods 204, 204 (FIG. 2*a*). It is understood that in alternate embodiments, support member 70 could be used or designed differently so as to adapt to different configurations of the armature grid.

Each end knobs 74, 76 include a two tiered peripheral rim 80 defining an inner permanent ring 80*a* integrally attached to central section 72, and an outer frangible hoop 80*b* attached to permanent ring 80*a*. Ring 80*a* and hoop 80*b* are separated by a score line 80*c*. Frangible hoop 80*b* comprises an alignment tab 80*d* projecting transversely therefrom, i.e. parallel to axis 72*a*.

Circumscribed within peripheral rim 80 of each knob 74, 76 are two alignment indentations 84 and 86 orthogonal to each other and meeting at the opening point 73 of the longitudinal cavity of support member central section 72.

Support member 70, as will be described in detail hereinafter, will become permanently embedded in a concrete structure which will have been cast within formwork assembly 30, and can therefore be used only once. Support members 70 should therefore be made from an inexpensive material, for example a moulded thermoplastic such as polyethylene. Once a concrete structure will have been cast in formwork assembly 30, and the formwork assembly detached from the concrete structure, a workman will grip tab 80*d* of the embedded support member 70, and twist it to rip the frangible hoop 80*b* apart from permanent ring 80*a* along score line 80*c*, for reasons detailed hereinafter.

In the assembled formwork 30, a number of support members 70 may support the optional armature grid 200 through the instrumentality of their curved fingers 78*a*, 78*b* (or 79*a*, 79*b*), and a corresponding elongated threaded rod 90 is inserted lengthwisely in the longitudinal cavity of each support member 70, such that both opposite end portions of the threaded rod 90 extend outwardly of and beyond the corresponding support member 70. Moreover, two panel connectors 44 are mounted on each exposed end portions of threaded rod 90, on either side of support member 70; a first connector 44 is mounted on the portion of threaded rod 90 extending out of end knob 74, and the other connector 44 is mounted on the portion of threaded rod 90 extending out of opposite end knob 76, as shown in FIG. 2*a*. Panel connectors 44 will serve to hold a rectangular array formwork panels 34 in an edgewisely juxtaposed fashion which will form continuous formwork walls 32, 32.

Each panel connector 44, as best shown in FIGS. 4*a*-4*b*, defines a main body 46 from which radially extends a number of first male dovetail joint means or tenons 48. The number of tenons 48 on connector 44 is equal to the number panels 34 that the connector is able to connect. Between each two peripherally successive tenons 48 is formed a trough 49. In the embodiment of the figures, connector 44 is provided with four regularly peripherally spaced radially extending lobe-shaped tenons 48. Connector 44 further defines a front face 50 and a rear face 52. A discoid protrusion 54 projects frontwardly from connector front face 50, and a series of C-shaped alignment protrusions 56 project frontwardly from discoid protrusion 54. Moreover, three through channels 60 are made across connector 44, and extend transversely through connector front face 50, between pairs of successive C-shaped protrusions 56, to rear face 52. Moreover, connector 44 comprises four alignment slots 62, each slot 62 being made in front face 50 at the base of one of the four tenon 48.

Panel connector 44 can be made for example from a sturdy moulded thermoplastic such as polypropylene.

When connector 44 is mounted on threaded rod 90, threaded rod 90 penetrates freely along and through the middle one of through channels 60 of connector 44, as can be seen in FIG. 2*a*. Moreover, when connector 44 is mounted on rod 90, slid towards and pressed against the facing end knob 74 or 76 of support member 70, alignment tab 80*d* of the facing end knob 74 or 76 is inserted in one of the four alignment slots 62 of connector 44, the discoid protrusion 54 becomes nested within the peripheral rim 80 of the facing end knob, and the C-shaped protrusions 56 of the connector interlock in one of the two alignment channels 84, 86. These mating connections of connector 44 with end knob 74 or 76 of support member 70 ensure proper relative alignment of the two elements.

Figure 5B:
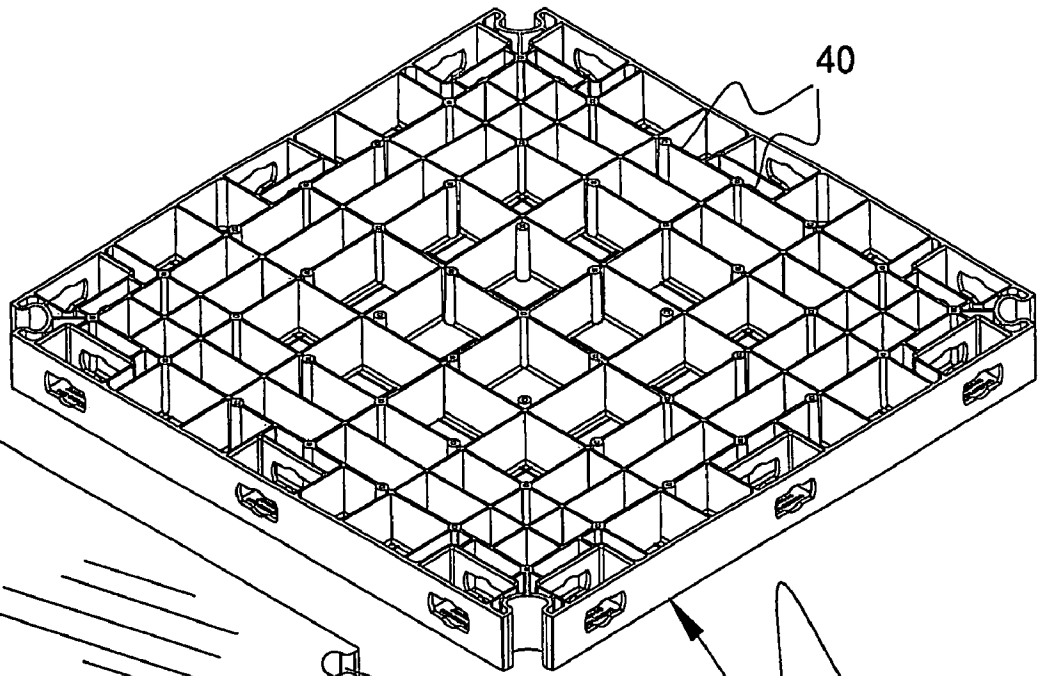
FIGS. 5*a*-5*b* show top and bottom perspective views of a flat-faced formwork panel.
Figure 5A:
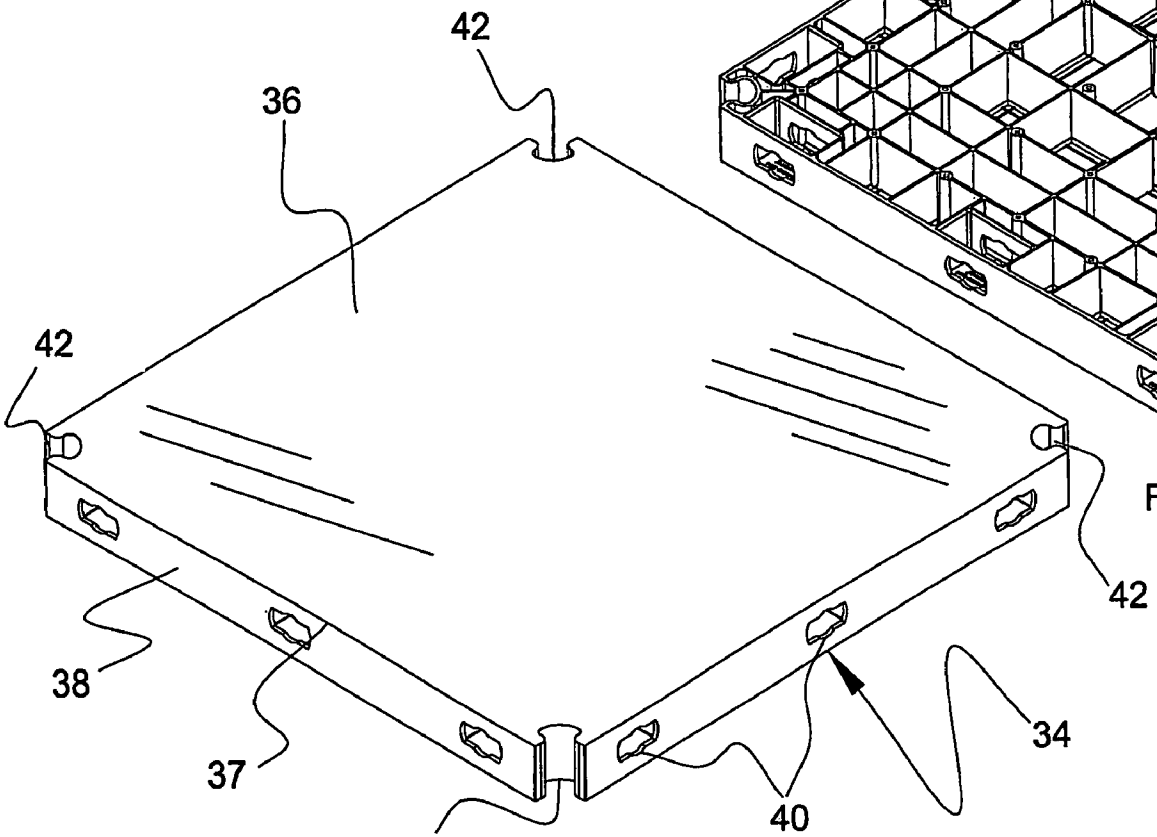

A number of rectangular panels 34 are destined to be coupled to connector 44 as shown for example in FIG. 2*a*. As shown in FIGS. 5*a*-5*b*, each panel 34 has a smooth planar front face 36 defining a peripheral edge 37, from which orthogonally and integrally depends a peripheral edging flange 38. The edging flange 38 of each panel 34 shown in the drawings is of generally rectangular shape, but it is understood that it could have other suitable shapes. Moreover, the back face of panel 34 is irregularly shaped and provided with a network of reinforcing ribs 40 imparting high mechanical resistance to the panel. Panels 44 are made from a sturdy material, for example from a moulded thermoplastic such as polypropylene. Polypropylene, in addition to being very sturdy, has the advantage of not significantly adhering to the concrete once it has set, and hence does not need be lubricated before use in order to enable economic retrieval thereof once the concrete has set.

A number of apertures 40 are made across the edging flange 38, each aperture 40 having a generally rectangular shape but defining an enlarged portion around its middle. A second dovetail joint means is formed at each corner of rectangular panels 34, as mentioned above, in the form of a female joint part or mortise 42. Each mortise 42 forms an inward recess in a corresponding corner of each panel 34, and the contour of mortise 42 is continuous and coextensive with edging flange 38.

Figure 6:
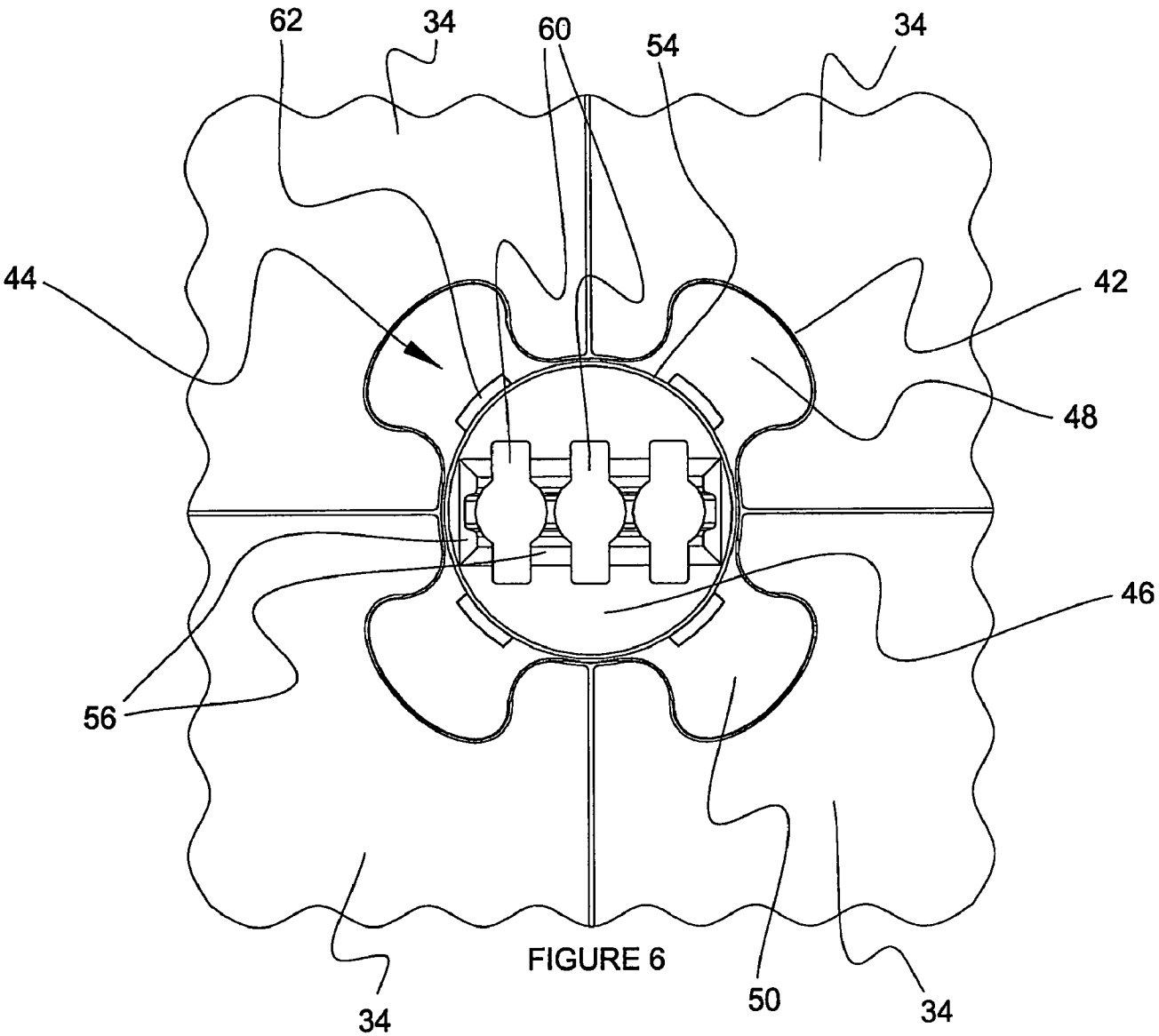
FIG. 6 shows a front plan view of a panel connector connecting four edgewisely juxtaposed panels, only part of each of the four panels being illustrated.

Mortises 42 of the panels 34 are of complementary shape to tenons 48 of the connector 44, and are designed to interlock together to form a dovetail joint. Connector 44 is designed to link four adjacent panels 34 by their meeting corner, as shown in FIG. 6, and to hold them so that they remain juxtaposed edge-to-edge. To connect a panel 34 to connector 44, its mortise 42 is lined up in front of one of the connector's tenon 48, and the panel is moved towards the connector so that its mortise 42 slides about and progressively interlocks with the connector's tenon 48, until the front face 36 of the panel abuts against the peripheral rim 80 of the facing end knob.

Figure 9:
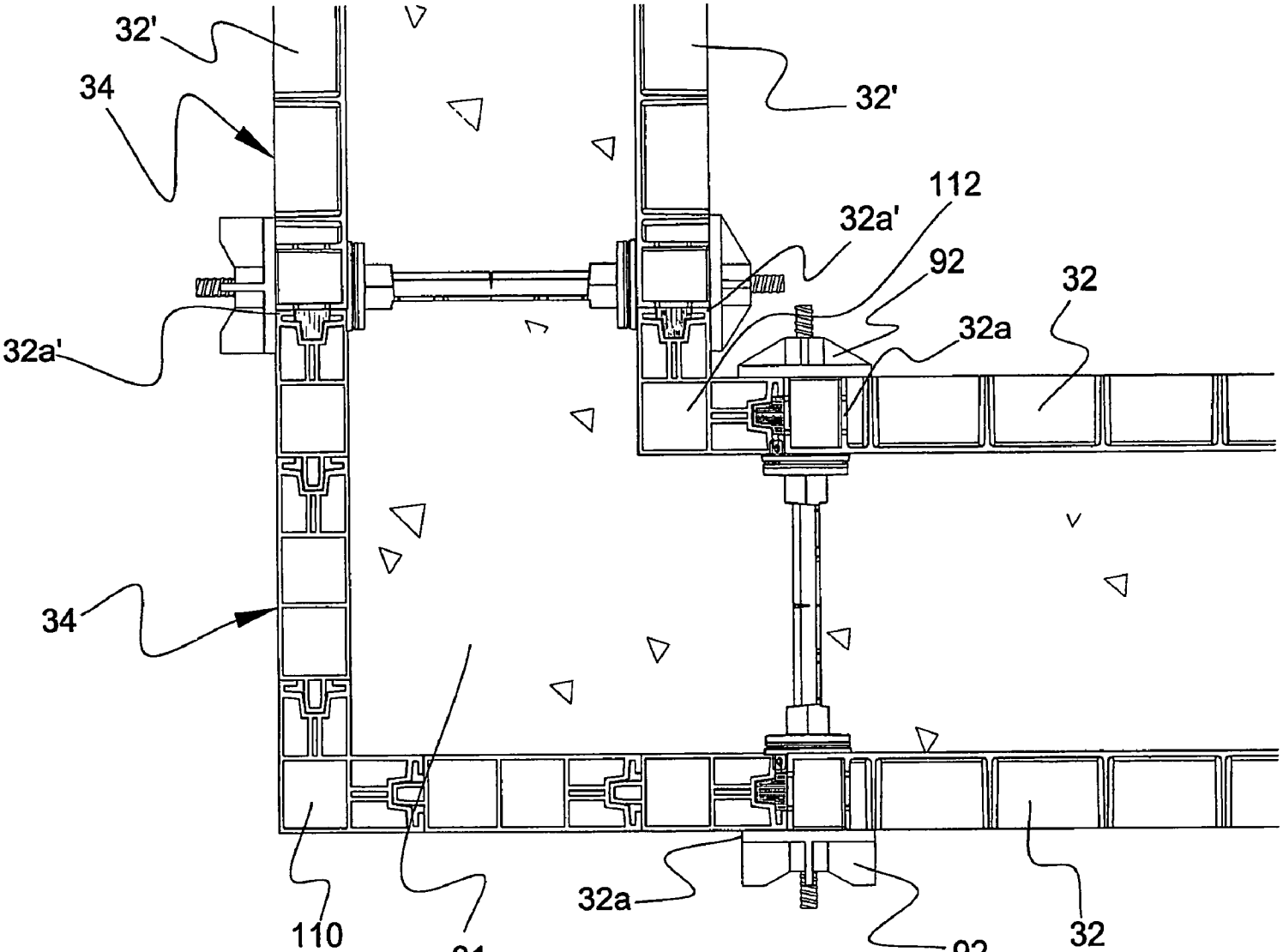
FIG. 9 shows a top cross-sectional view of a corner of a concrete-filled formwork assembly for upright walls of a building according to the present invention.

To secure the dovetail joints formed by the engagement of the connectors' tenons 48 in the panels' mortises 42, securing members in the form of wing nuts 92 are screwed on both ends of threaded rod 90, against the outer face of formwork walls 32, 32, to press the two connectors 44 located at opposite ends of the threaded rod, along with the four panels interlocked with each of the connectors, against the peripheral rim 80 of either one of support member end knobs 74 or 76 (FIG. 9). Wing nuts 92, when tightened, solidly binds both opposite connectors 44, the two set of four panels connected to each connector, and support member 70 together. When bound together, the front face 50 of the connector 44 and the front face 36 of the panels 34 connected thereto are coplanar. This will prevent formation of irregularities in the solidified concrete structure at the vicinity of the connections of panels 34 to connectors 44, and will contribute to the overall smoothness and flatness of the faces of the concrete structure cast between the spaced formwork walls 32, 32.

Figure 7:
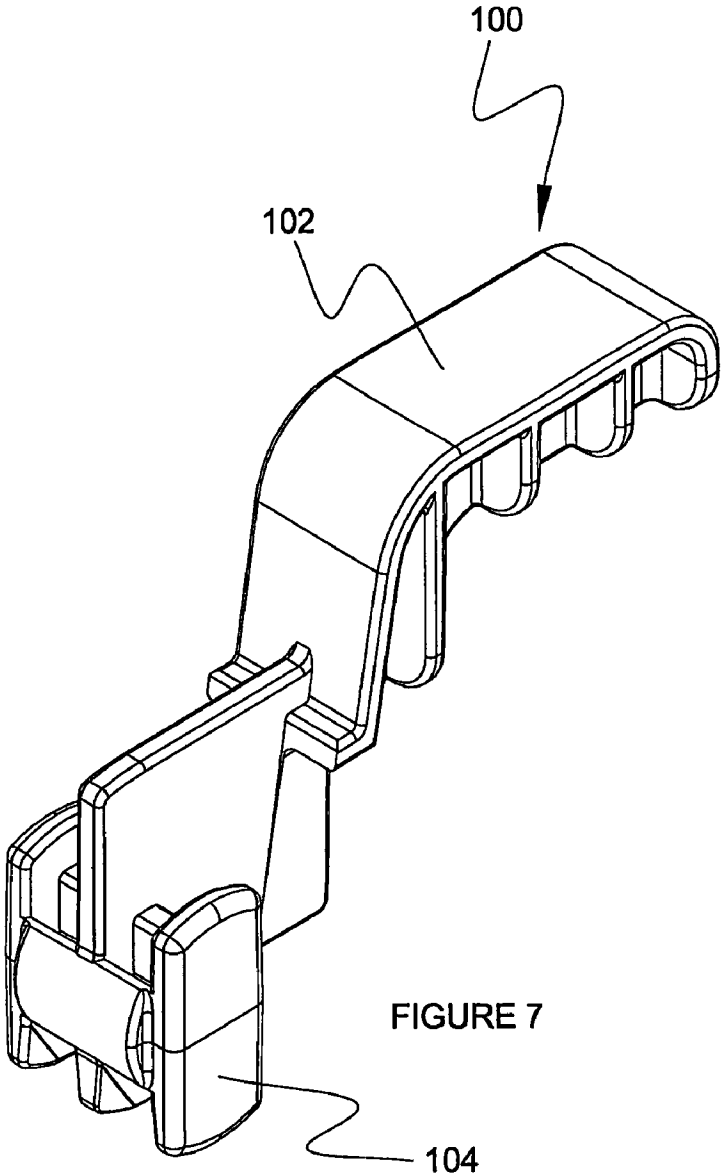
FIG. 7 is a perspective view of a fastening key destined to secure contiguous panels together.
Figure 8:
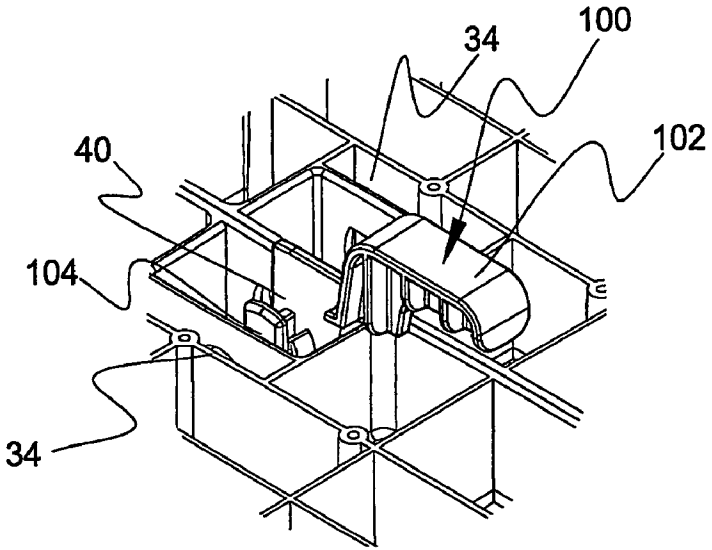
FIG. 8 shows a perspective view of the fastening key of FIG. 7 installed between a pair of contiguous formworks panels, the key being shown in its locking position, only part of each panel being shown.

When two contiguous panels 34 are connected to the same connector 44, their apertures 40 are lined up and register together. To further secure panels 34 together, fastening means such as a fastening key 100 illustrated in FIG. 7 can be used to conveniently join juxtaposed sides of the rectangular edging flanges 38 of two contiguous panels 34. Key 100 integrally comprises a handle 102, and a locking head 104. To secure juxtaposed edging flanges 38 of two contiguous panels 44 together, locking head 104 is inserted laterally through registering apertures 40 of both panels 44, and key 100 is pivoted into a locking position to fasten the edging flanges 38 of the two panels 34 together (FIG. 8). In the embodiment shown in the figures, panels 34 comprise three apertures 40 on each of the four sides of their rectangular edging flange 38, and therefore a maximum of three keys 100 can be used to secure adjoining edging flange sides of adjacent panels 34 together. It is understood that suitable alternate fastening means other than keys 100 could be used to fasten juxtaposed sections of the peripheral edging flange of contiguous panels together.

A supporting structure must be provided to hold formwork walls 32, 32 in a vertical position. For example, propping braces (not shown) can be used on the formwork walls 32, 32 to prop and hold them in a vertical position. Accordingly, the first end of the propping brace can be jammed between wing nut 92 and an additional wing nut 94 screwed on rod 90 (FIG. 2*b*), and the other end of the propping brace can be suitably anchored to the ground, to prop formwork wall 32 in a vertical position.

The installation procedure of formwork assembly 30 will now be described. It is understood that the following installation procedure is given as an example and is not intended to limit the scope of the invention; it will be appreciated by users of the invention that the installation steps set forth hereafter could be accomplished in a different order.

The two parallel spaced formwork walls 32, 32 can be installed one after the other, or simultaneously.

To set up one of the formwork walls 32, 32, a first support member 70 may support armature grid 200, as shown in FIGS. 2*a*-2*b*. Then, a rod 90 is inserted in the support member 70, and a connector 44 is slid onto rod 90 so that rod 90 penetrates into the middle one of channels 60, and so that the front face 50 of connector 44 faces support member 70, and so that connector 44 interlocks with end knob 76 (or 74) of the support member as described hereinabove. Thereafter, four panels 34 are joined to connector 44, by fitting one of their mortises 42 into a corresponding tenon 48 of the connector 44. Once the four panels 34 are joined to connector 44, a first wing nut 92 is screwed onto threaded rod 90 in order to press both the panels 34 and the connector 44 against the peripheral rim 80 of the support member's end knob 76. Thereafter, keys 100 are installed between pairs of contiguous panels 34, to join sides of their respective edging flanges 38.

The procedure is then repeated to progressively assemble and erect the continuous formwork wall. The assembled formwork wall 32 is liquid tight, in the sense that it will not allow the infiltration of liquid concrete therethrough.

It is understood that the formwork walls are substantially sealingly connected to the ground. Such a sealed connection to the ground can be accomplished for example by sealingly fitting the bottom edge portion of the formwork wall 32*b* (FIG. 1) into a dedicated groove made in a rail (not shown) sealingly bearing on the ground. This rail could also serve as a supporting structure to hold the formwork walls 32, 32 in a vertical position.

As described above, propping braces (not shown) can optionally be installed between each of the assembled formwork walls 32, 32 and the ground to prop them in an upright position.

Any suitable means could be used to join the free lateral edges 32*a*, 32*a* (FIG. 1) of parallel formwork walls 32, 32, to each other or to other formwork walls oriented in a different direction, in order for formwork assembly 30 to define a liquid-tight enclosure into which poured concrete can be contained. For example, to connect perpendicular pairs of formworks walls 32, 32 and 32', 32' into a corner (FIG. 9), inner and outer corner brackets 110 and 112 can be suitably sealingly attached between the free lateral edge 32*a*, 32*a* to 32*a*', 32*a*' of both formwork wall pairs 32, 32 and 32', 32'.

Once all the walls of the formwork 30 have been suitably assembled, and joined so that formwork 30 defines a load bearing liquid-tight pouring enclosure 31 (FIG. 9), concrete can be poured in enclosure 31.

Once the concrete has hardened, the formwork walls are preferably removed from the hardened concrete structure for economic reuse thereof. The removal procedure could be accomplished by following these steps for example:

Unscrewing wing nuts 92 (and optional wing nuts 94);

Removing the threaded rods 90 slidingly out from support member 70. Indeed, the threaded rod 90 is not embedded in the concrete as the longitudinal cavity of the support member 70 in which it was nested provided liquid-tight "shelter" for it.

Figure 10:
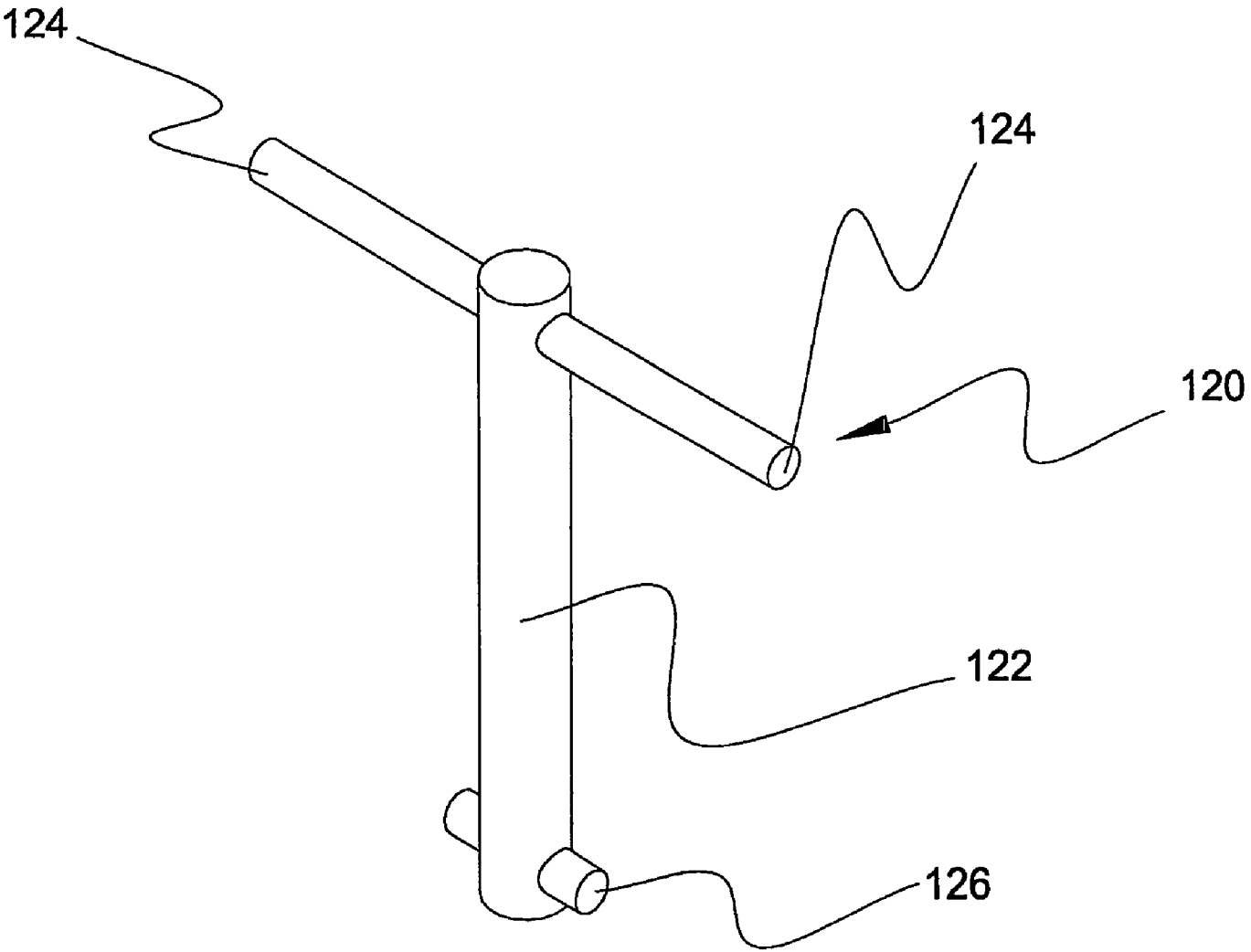
FIG. 10 is a front perspective view of a connector removal tool.

Removing connectors 44. A connector removal tool 120 (FIG. 10) comprising a main shank 122 carrying handlebars 124 at one end and hook portions 126 at the opposite end, can be used for this task. A workman has to insert the end of shank 122, along with the two hook portions 126, in one of channels 60 made in connector 44, and then twists and pivots the tool using handle bars 124 so that the hook portions 126 engage dedicated and complementary removal notches (not shown) made within channels 60 of connector 44, in order for the tool to get a grip on the connector. The workman can then simply pull on the connector removal tool 120 to disconnect and disengage the connector 44 from the surrounding panels 34, and from the facing end knobs 74 or 76 of the support member 70.

Removing the assembly of panels 34. Panels 34 can be pulled away from the concrete structure after removal of the connectors 44. Even though they are no longer attached to the concrete structure, all panels of a given formwork wall 32 are still attached to each other by keys 100, and all panels 34 of the formwork wall 32 can be pulled as one away from the concrete structure. An advantage of pulling the whole assembly of panels 34 away from the concrete wall as one without detaching them from one another is that it can be set up at another location, without having to disassemble and reassemble the panels one by one. Indeed, this assembly of panels can be brought to another location, a number of support members 70 and connectors 44 can be connected to it as described hereinabove, and the optional armature grid 200 can then be attached to the support members 70.

Ripping frangible hoop 80*b* off end knobs 86 of support members 70. Once the concrete has set in the formwork, the support members 70 become embedded in the hardened concrete structure, and the outer rim of frangible hoop 80*b* of end knobs 74 and 76 are level with the outer surfaces of the hardened concrete wall. The workman can twist tab 80*d* to rip frangible hoop 80*b* along score line 80*c* apart from permanent ring 80*a*. Accordingly, the outer rim of end knob 74 (or 76) becomes recessed inwardly in the outer surface of the concrete wall, and the hole in the concrete wall formed around end knob 74, 76 can be filled with concrete putty, in order to form a continuous finished concrete structure.

It is of course understood that the above steps could be accomplished in a different order without departing from the scope of the invention.

Figure 11:
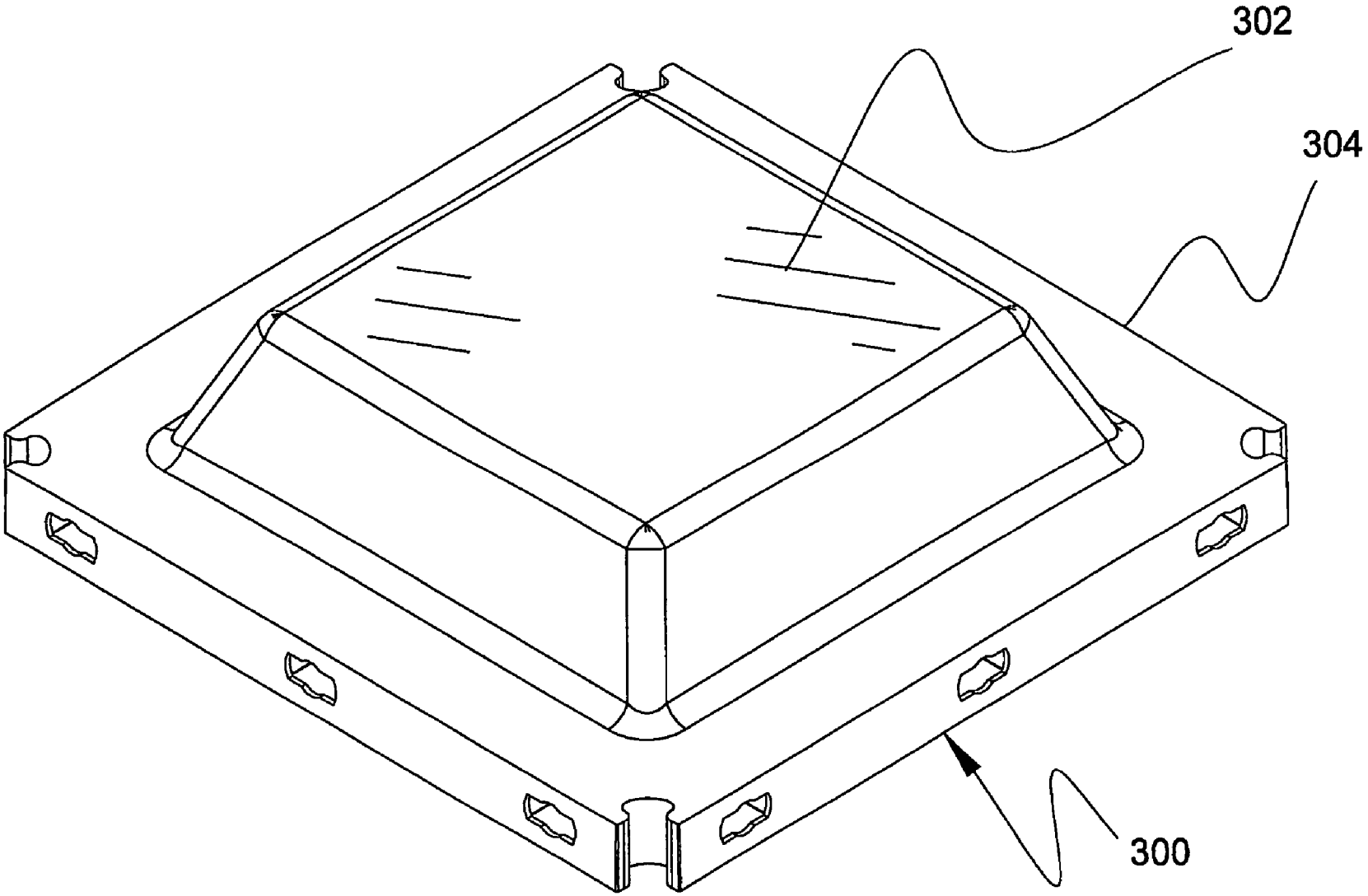
FIG. 11 shows a top perspective view of another type of formwork panel.

The present invention could be used with a variety of panels other than flat-faced panels 34, which could have different shapes, sizes, etc. For example, there is shown in FIG. 11 a panel 300 similar to panel 34 but which comprises a central rectangular projection 302 in the center of its front face 304. This central projection 302 will create complementary indentations in the hardened concrete structure.

Figure 12:
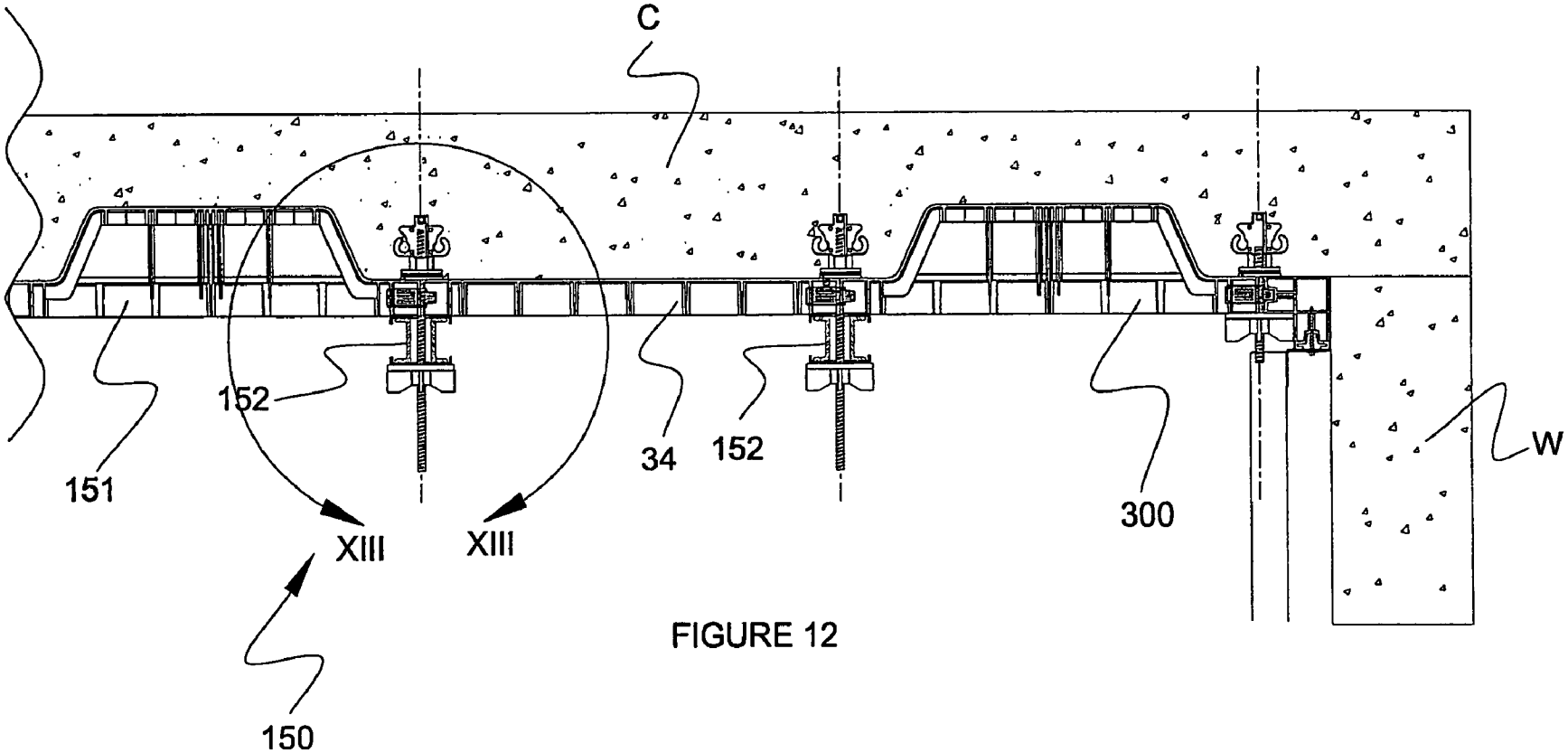
FIG. 12 shows a partial front cross-sectional view of a formwork assembly horizontally disposed for forming a concrete ground-spaced ceiling of a building.
Figure 13:
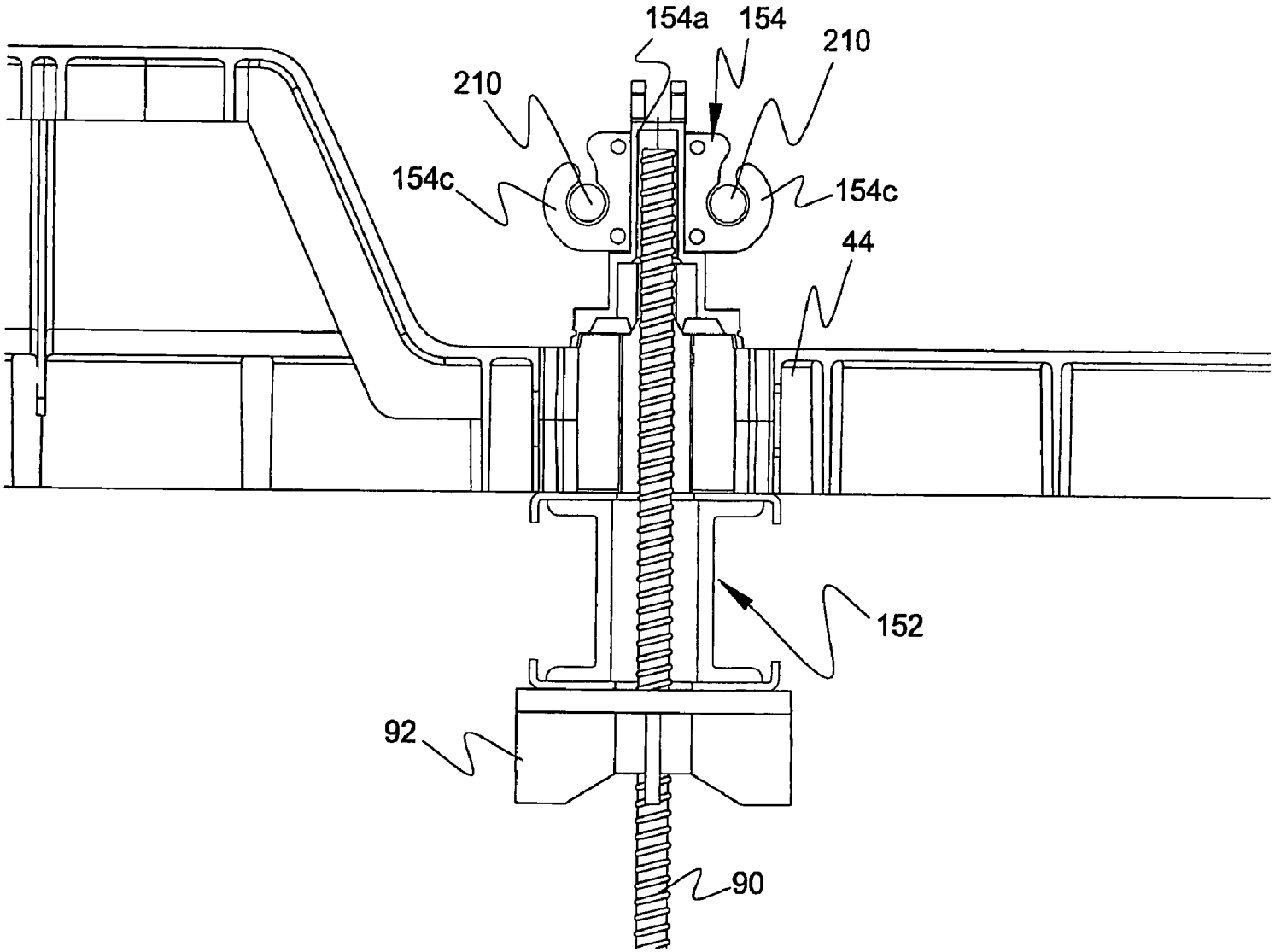
FIG. 13 shows an enlarged view of the area circumscribed within ellipse XIII-XIII of FIG. 12.

The formwork assembly comprising dovetail joint connectors according to the present invention is not limited in use to casting vertical walls, but could also be used to cast other concrete structures such as concrete floors or ceilings for example. In FIG. 12, there is shown a formwork assembly 150 laid in a horizontal position and destined to cast a concrete ceiling C extending orthogonally from the top of a vertical concrete wall W. Formwork assembly 150 comprises only one bottom formwork wall 151 having a mixed set of panels 34 and 300. It can be seen on FIGS. 12-13 that the formwork wall 151 rests on a substantially horizontal supporting structure comprising a series of parallel and regularly spaced apart support joists 152, which maintain the formwork assembly 150 in an elevated position.

Formwork assembly 150 comprises support members 154 instead of the previously described support member 70. Support members 154 comprise a threaded inner cavity 154*a* instead of an unthreaded one, and comprise only one end knob 154*b* and only two curved fingers 154*c*, 154*c* engaging a pair of horizontal and parallel armature rods 210.

When used in a horizontal position for forming floors or ceilings, threaded rods 90 are screwed in the threaded inner cavity 154*a* of support members 154*b*, and extend through connectors 44 and support joists 152. Wing nuts 92 are screwed and pressed on support joists 152 in order to secure panels 34 or 300 and connectors 44 to support joists 152.

The installation procedure for formwork assembly 150 will now be described. First, the supporting structure composed of the series of horizontally arranged floor joists 152 is appropriately set up, such that it is suitably maintained in an elevated position. Then, a threaded rod 90 is freely inserted through one of the support joist 152 and through the middle through channel 60 of an overhanging connector 44, and is screwed into the threaded inner cavity 154*a* of support member 154. Four panels 34 and 300 are then interlocked with the connector, and a wing nut 92 is screwed onto threaded rod 90 against support joist 152 to secure the four panels, the support member 154, the connector and the support joist 152 together. The procedure is repeated to progressively complete the assembly of the formwork.

Generally, the vertical walls of the building, such as vertical concrete wall W of FIG. 12, will have been built before the setting up of formwork assembly 150, i.e. before casting the elevated concrete ceiling. Therefore, the formwork wall 151 will form the bottom wall of the pouring enclosure that will contain the concrete, and the four vertical walls surrounding the formwork assembly 150, which extend upwardly beyond the top surface of formwork wall 151, will form the side walls of the pouring enclosure. It is understood that any suitable alternate means for forming the side walls of the pouring enclosure could be used.

Thereafter, once the liquid concrete has been poured in the pouring enclosure and has hardened to form a horizontal concrete slab, formwork assembly 150 can be taken apart. Wing nuts 92 are unscrewed from threaded rods 90, threaded rods 90 are unscrewed from the threaded inner cavity of the support member 154 (which has become embedded in the hardened concrete slab) and removed, and then the support joists, the connectors and the panels 44 are removed and taken away from the concrete slab. All the components of the formwork assembly which have been detached from the concrete slab, i.e. every component except concrete-embedded support members 154, can be reused subsequently.

The present invention therefore generally relates to a formwork system comprising at least one formwork wall, the formwork wall comprising at least two edgewisely juxtaposed panels each having first dovetail joint means, the panels being retained together using panel connectors comprising second dovetail joint means complementary to and interlocking with the first dovetail joint means of the panels. In the embodiments shown above, the male dovetail joint means were comprised on the connectors (tenons 48) and the female dovetail joint means were comprised on the panels (mortises 42). In alternate embodiments, the female joint means could be inversely located on the connectors, and the corresponding male joint means could be located on the panels without departing from the scope of the invention.

Moreover, the male and female parts of the dovetail joint formed between panels 34 and connector 44 are illustrated in the figures as having a lobe-shaped and curved contour, but could be of any suitable shape as long as male and female parts interlock to form a dovetail joint.

The formwork system of the present invention can be easily assembled without any advanced construction skills or special tools, all at a low cost. Since each panel module 34 is pre-manufactured in a remote plant before being shipped to the construction site, low defect rate can be expected in upright walls and floor slabs. A good quality paint applied on the exposed concrete surface will be sufficient, since the exposed concrete surface will already be quite smooth, without requiring a rough-coat plaster layer.

Each modular panel 34 being lightweight, shipping costs will be low. It is envisioned that each modular panel 34 would have a useful life of several hundreds of applications, i.e. could be reused hundreds of times.

Moreover, with the modular system of the present invention, the width and length of the concrete structure to be formed can be easily varied by assembling the desired number of rows and columns of formwork panels during the assembly of the formwork walls.

It is understood that:

alternate shapes of panels that have not been shown in the figures, alternate securing means other than wings nuts 92, alternate supporting structures for holding the formwork wall(s) in the desired position;

alternate support member means other than support members 70 or 154, and alternate fastening means other than fastening keys 100 could be used without departing from the scope of the present invention.

The invention claimed is:

1. A liquid-tight formwork wall for use in a formwork assembly for forming a concrete structure, said formwork wall comprising:

at least two panels each defining a front face, a rear face and a peripheral edging extending between said front face and said rear face, each one of said panels having at least one first dovetail joint means made continuously and coextensively on said peripheral edging;

a panel connector having at least two second dovetail joint means coplanar with said first dovetail joint means, each said second dovetail joint means being complementary to said first dovetail joint means of a corresponding one of said panels; wherein each said second dovetail joint means is interlocked with said first dovetail joint means of a corresponding one of said panels to form a dovetail joint therewith, in order for said connector to hold said panels in an edgewisely juxtaposed coplanar fashion to form said formwork wall, and wherein said panel connector extends generally within the plane of said at least two panels;

a securing member for securing said connector and said panels with one another; and at least one support member attached to said formwork wall, for supporting an armature grid adjacently to said formwork wall, wherein said at least one support member defines opposite first and second ends, and is attached at said first end to a first one of said formwork wall, and is further attached at said second end to a second one of said formwork wall, said support member maintaining said first and second formwork walls spaced apart from each other.

2. The formwork wall according to claim 1, wherein said first dovetail joint means are female dovetail joint means, and said second dovetail joint means are male dovetail joint means.

3. The formwork wall according to claim 2, wherein each said male dovetail joint means of said connector is lobe-shaped.

4. The formwork wall according to claim 1, wherein said peripheral edging of each of said panels has a generally quadrangular shape, and each panel thus defines four corners.

5. The formwork wall according to claim 4, wherein each one of said panel comprises a first dovetail joint means at each one of said corners thereof.

6. The formwork wall according to claim 1, further comprising at least one fastening means for fastening together juxtaposed sections of said peripheral edging of said at least two panels of said formwork walls.

7. The formwork wall according to claim 1, further comprising an elongated threaded rod having at least one end portion extending outwardly of said support member, said threaded rod penetrating across a through channel made in said panel connector, said securing member including a nut screwed onto said threaded rod and pressing said connector and said panels against said support member.

8. A formwork assembly for casting a concrete structure, said formwork assembly comprising:

at least one liquid-tight and load-bearing formwork wall, said formwork wall comprising:

at least two panels each defining a front face, a rear face and a peripheral edging extending between said front face and said rear face, each one of said panels having at least one first dovetail joint means continuously and coextensively on said peripheral edging; and a panel connector having at least two second dovetail joint means coplanar with said first dovetail joint means, each said second dovetail joint means being complementary to said first dovetail joint means of a corresponding one of said panels; wherein each said second dovetail joint means is interlocked with said first dovetail joint means of a corresponding one of said panels to form a dovetail joint therewith, in order for said connector to hold said panels in an edgewisely juxtaposed coplanar fashion to form said formwork wall, whereby said panel connector extends generally within the plane of said at least two panels;

a supporting structure supporting said formwork wall in a desired position;

a securing member for securing said connector, said panels and said supporting structure together; wherein said supporting structure holds said formwork wall in a horizontal position and comprises a number of horizontally arranged floor joists, and wherein said panel connector registers with said support member and with one of said floor joists, said formwork assembly further comprising an elongated threaded rod having at least one end portion extending outwardly of said support member, said threaded rod penetrating across a through channel made in said panel connector and through said floor joist, said securing member including a nut screwed onto said threaded rod securing said panel connector, said panels, said support member and said floor joists together.

9. The formwork assembly according to claim 8, wherein said first dovetail joint means are female dovetail joint means, and said second dovetail joint means are male dovetail joint means.

10. The formwork assembly according to claim 8, wherein said peripheral edging of each of said panels has a generally quadrangular shape, and each panel thus defines four corners.

11. The formwork assembly according to claim 10, wherein each one of said panels comprises a first dovetail joint means at each one of said corners thereof.

* * * * *